US006027420A

United States Patent [19]

Soong

[11] Patent Number: 6,027,420

[45] Date of Patent: Feb. 22, 2000

[54] SPORTS RACKET HAVING A FRAME WITH DISCONTINUOUS BOUNDARY

[76] Inventor: Tsai C. Soong, 1839 Jackson Rd., Penfield, N.Y. 14526

[21] Appl. No.: 09/170,389

[22] Filed: Oct. 13, 1998

[51] Int. Cl.[7] ..... A63B 49/02

[52] U.S. Cl. ..... 473/540; 473/546

[58] Field of Search ..... 473/524, 534, 473/540, 543, 546

[56] References Cited

U.S. PATENT DOCUMENTS

| | | | |
|---|---|---|---|
| 3,089,118 | 5/1963 | Fritsch | 473/534 |
| 4,595,201 | 6/1986 | Fischer | 473/534 |
| 4,754,968 | 7/1988 | Fischer | 473/534 |
| 5,137,273 | 8/1992 | Jseng | 473/543 |
| 5,306,004 | 4/1994 | Soong | 473/546 X |

FOREIGN PATENT DOCUMENTS

| | | | |
|---|---|---|---|
| 2226250 | 6/1990 | United Kingdom | 473/FOR 181 |

*Primary Examiner*—Raleigh W. Chiu
*Attorney, Agent, or Firm*—Bernard A. Chiama

[57] ABSTRACT

A sports racket, particularly a tennis racket, comprises a handle and a frame, including a head part, a middle part, a throat element and a shank element, and a string system composed of a lateral string segments and a longitudinal string segments, wherein the majority of the longitudinal string segments pass through the openings in the throat element, enter and anchored at the shank element; and at least for two longitudinal string segments, one on each side of the longitudinal axis, which are anchored at the shank element, there is no structural member of the frame standing between said string segment and the outboard space beyond. The frame, which surrounds the string network, is essentially not continuous.

13 Claims, 1 Drawing Sheet

SPORTS RACKET HAVING A FRAME WITH DISCONTINUOUS BOUNDARY

BACKGROUND OF THE INVENTION

Tennis players who had experience with the earlier wood racket still favor the simplicity and control of the racket. The long wood handle attached directly to a small oval frame with string network seemed to make aiming and hitting the ball a simple and less complicated matter. The weakness had been its small head due to limitation of the heaviness of the material. Of course, the light and strong graphite fiber racket with the open, yoke type throat and large head is now predominating, but it does not mean that there is no merit in the earlier racket we can not learn anything from it in today's standard In U.S. Pat. No. 4,437,662, Soong disclosed a string network, wherein a majority of longitudinal strings, converge at an angle, inclined with respect to the axis of the frame, from the head to the handle and anchored at a string seat in the shank region behind the throat. The racket has great power and control.

The present invention retains the Soong concept of stringing, but the frame of the racket is changed back to the earlier, classical form of the wooden racket in which the throat is not the open yoke type, and the shank is simply a beam extension of the handle which engages the throat almost at a perpendicular direction.

DESCRIPTION OF THE PREFERRED EMBODIMENTS

A tennis racket is used to illustrate the innovative concept, but it is understood that the concept applies to other applicable sports rackets including racket ball racket, badminton, etc.

Figure 1:
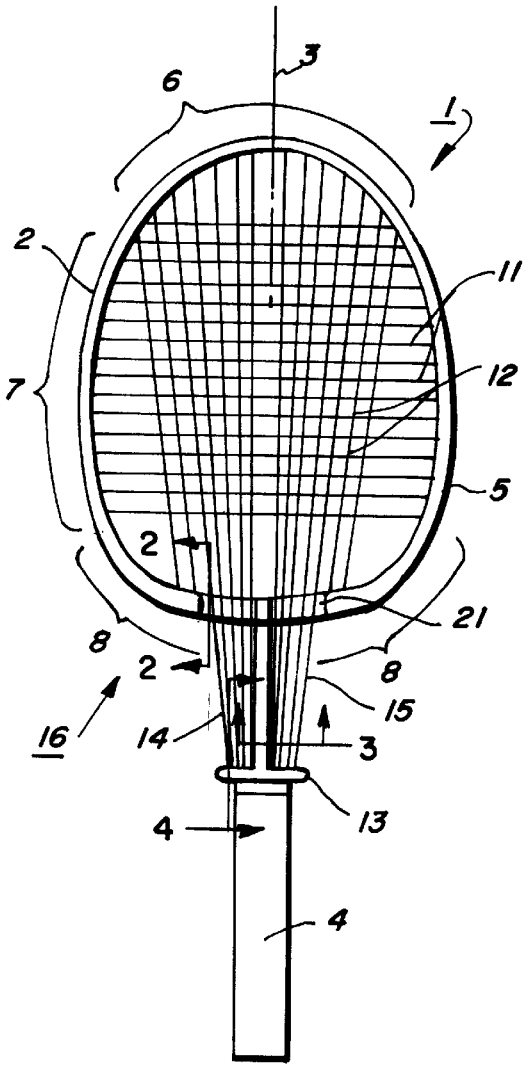
FIG. 1 is a plane view of the frame of the innovative tennis racket cut at the stringing plane of the frame with the string network in place.

FIG. 1 is a plane view of a preferred embodiment of an invention racket 1 cut at the stringing plane of the frame, wherein a racket body 2 having a longitudinal axis 3 which forms a handle 4 and a frame 5 composed of structural load-carrying members, including, from top down, a head part 6, a middle part 7, a curved throat element 8 and a straight shank element 9 which connects the throat element of the frame to the handle.

Figure 2:
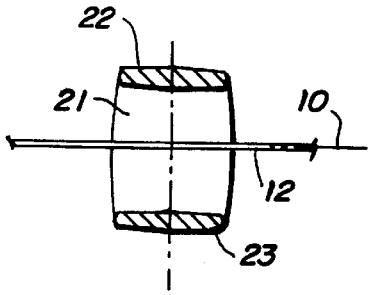
FIG. 2 is the 2—2 section in FIG. 1 where a cut is made at the throat element to show detail of the hollow frame.

The racket body also includes a string system defining a stringing plane 10, shown in FIG. 2, which coincides with the mid-plane of the racket body, composed of two string segment systems. Each segment possesses two ends, anchors on the members of the frame. The lateral string segments 11 run approximately perpendicular to the longitudinal axis 3, from one side of said axis to the opposite side, and intersect with the longitudinal string segments 12, which run from the head part towards the handle.

In one detail embodiment, shown in FIG. 2, a cut section 2—2 of the throat element 8 of FIG. 1, wherein a majority of the longitudinal string segments pass through the opening 21, between the upper and lower walls, towards the shank element 9.

Figure 3:
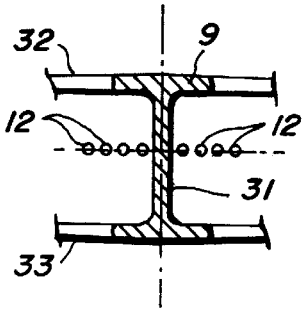
FIG. 3 is the 3—3 section in FIG. 1 where a cut is made at the shank element to show the I-beam type of the detail of the structure.

Another detail embodiment is shown in FIG. 3, which is a cross section 3—3 of the shank element 9 of FIG. 1. The cross section shows an I-beam, wherein the majority of the longitudinal string segments 12, which pass through the opening 21 of the throat element, is converging to be anchored. They spread evenly on both sides of the central column 31 of the I-beam.

The upper flange 32 of the I-beam may join the upper wall 22 of the throat, and the lower flange 33 may join the lower wall 23.

A preferred arrangement of anchoring the longitudinal string segments at the shank element is shown in FIG. 1 by having a string seat 13 which is shown as a bar element in the stringing plane, extending outwardly and symmetrically on both sides of the central column 31. There may be more than one of such seats. Some other types of anchoring devices may also be used.

A structural feature of the invention is that the plane form of the racket body as seen from above, without the string system, resembles the classical frame of the wood tennis racket. The improvement here is that by having the shank in the form of a straight beam directly joining the handle to the throat, a two-armed yoke of the modern design embracing the throat all the way from the handle to the wide side of the throat is no longer needed. In the meantime, advantage is taken of Soong's teaching, having the long strings anchored far down the shank, passing through the hollow throat, making the oval, string network area large and powerful but without the burden of a heavy yoke. This is the gist of the invention.

In joining the wood type racket frame and the Soong's stringing pattern, the structural characteristics of the present invention is:

At least for two longitudinal string segments, one on each side of the longitudinal axis, such as 14 and 15 in FIG. 1, which are anchored at the region of the shank element, there is no structural member of the frame, standing between said string segments and the outboard space beyond, such as the space 16 and 17 respectively in FIG. 1. In other words, as far as the string network is concerned, the boundary encircled by the structural members of the frame is not continuous. At least some string segments are left outside the supposedly closed boundary of the frame.

Since it is the purpose to simulate the design of the classic wood racket, and the wood tennis racket in particular, the proportion of the longitudinal length of the oval part of the frame to the length of the handle is a good design guide to retain and capture the merit of the classic wood racket. By measuring dimensions of the wood racket, tried different inclination of longitudinal string segments, anchor positions, throat element positions and length of shank element, all of which influenced effective playing area and vibration area of the string network, the following optimum design criterion is preferred:

The length of the shank element is not less than about 30% of the combined length of the head part, the middle part and the throat element put together and projected on the longitudinal axis of the body.

A majority of the longitudinal string segments, which enter the region of the shank element, are anchored in a string seat rigidly attached to the shank element.

The length of the shank element plus the length of the handle, are not less than about 50% of the total length of the racket body along its longitudinal axis.

The general shape of the cross section of the shank element is approximately an I-beam type wherein the central column 31 of the I-beam is perpendicular to the longitudinal axis of the racket body.

The general shape of the cross section of the shank element is approximately a hollow box type wherein the principal axes of the box section is perpendicular to the longitudinal axis of the racket body.

The majority of the longitudinal string segments anchored at the string seat, approach and leave the string seat in at least two elevation levels, so as to reduce the spacing required to properly accommodate them in the limited width of the seat, wherein one level is above the stringing plane and another level is below the stringing plane.

The string seat is located not less than about 81% of the length, measured from the top of the head part, of the combined projected length of the head part the middle part, the throat element and the shank element put together.

The string seat is located not less than about 38.0 cm, measured from the top of the head part.

The majority of the longitudinal string segments are generally converging from the head part towards the shank element.

The majority of the longitudinal string segments which anchor at the string post wind spirally like a screw thread to turn around the extended post of the seat for support wherein groves are provided on the surface of the post to guide the string.

Figure 4:
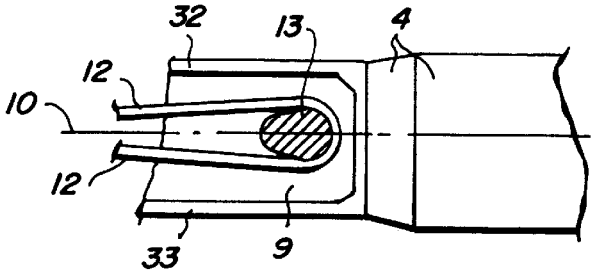
FIG. 4 is the 4—4 section in FIG. 1 showing the string post and the turn around of a longitudinal string.

The last description is illustrated in FIG. 4, wherein the cut section 4—4 of FIG. 1 shows the longitudinal string 12 turning around the string seat 13 which is in the form of a circular post. Another efficient anchoring is that there is a vertical hole replacing the surface grove in the circular post, so that the string enters the hole and leaving it vertically rather than being turned around.

What is claimed is:

1. A sports racket comprising:

a racket body having a longitudinal axis, which formed with a handle and a frame provided with at least of structural load-carrying members, including a head part, a middle part, a throat element and a shank element connecting said throat element of said frame to said handle, and a string system defining a stringing plane having at least two string segment systems, one system for the longitudinal string segments of the racket and the other system for the lateral string segments, each one string segment possessing two ends anchored on said members of the frame, wherein said lateral string segments, which run approximately perpendicular to the longitudinal axis of the racket body, from one side of said axis towards the opposite side, intersect with the longitudinal string segments, which run from the head part towards the handle, wherein said throat element having a portion thereof at least partially hollow forming openings enabling a majority of said longitudinal string segments to pass through, enter and be anchored adjacent said shank element, and wherein at least for two longitudinal string segments, one on each side of the longitudinal axis, which are anchored at said shank element, there is no structural member of the frame positioned between said two longitudinal string segments and the outward space beyond.

2. The sports racket according to claim 1, wherein the shank element, having a first end and a second end is a beam type structural entity; said throat element having two arms joined to the first end of the shank element as a fork, the other end, the second, is one end of the handle.

3. The sports racket according to claim 2 wherein the length of the shank element is about 30% of the combined length of the head part, the middle part and the throat element put together and projected on the longitudinal axis of the body.

4. The sports racket according to claim 2 wherein the length of the shank element plus the length of the handle, is about 50% of the total length of the racket body along its longitudinal axis.

5. The sports racket according to claim 2, including a string seat positioned adjacent said shank element, and wherein a majority of the longitudinal string segments, which enter the region of the shank element, are anchored in said string seat.

6. The sports racket according to claim 2, wherein the general shape of the cross section of the shank element is approximately an I-beam wherein the axis of the central column of the I-beam is perpendicular to the longitudinal axis of the racket body.

7. The sports racket according to claim 2, wherein the general shape of the cross section of the shank element is approximately a hollow box wherein the major axes of the box section is perpendicular to the longitudinal axis of the racket body.

8. The sports racket according to claim 5, wherein the majority of the longitudinal string segments anchoring at the string seat, approach and leave the string seat in approximately at least two elevation levels, so as to reduce the width required to properly accommodate them in the limited width of the string seat, one level is above and another level is below the stringing plane.

9. The sports racket according to claim 5, wherein said string seat is located about 81% of the length, measured from the top of the head part, of the combined projected length of the head part, the middle part, the throat element and the shank element put together.

10. The sports racket according to claim 5, wherein said string seat is located about 38.0 cm, measured from the top of the head part.

11. The sports racket according to claim 1, wherein the majority of the longitudinal string segments are generally converging from the head part towards the shank element.

12. The sports racket according to claim 5, wherein the majority of the longitudinal string segments which anchor at the string seat wind spirally like a screw thread to turn around the extended post of the seat for support wherein groves are provided on the surface of the post to guide the string.

13. The sports racket according to claim 5, wherein said string post including an extended post formed with openings therein and wherein the majority of the longitudinal string segments which anchor at the string seat, enter and leaving said the extended post through said holes whose direction is perpendicular to the stringing plane.

* * * * *